US011950632B2

(12) United States Patent
Kim et al.

(10) Patent No.: US 11,950,632 B2
(45) Date of Patent: Apr. 9, 2024

(54) AEROSOL GENERATING APPARATUS FOR DETECTING INSERTION OF AEROSOL GENERATING ARTICLE AND OPERATION METHOD THEREOF

(71) Applicant: KT & G CORPORATION, Daejeon (KR)

(72) Inventors: Yong Hwan Kim, Gyeonggi-do (KR); Dae Nam Han, Seoul (KR); Dong Sung Kim, Seoul (KR); Seung Won Lee, Gyeonggi-do (KR); Seok Su Jang, Daejeon (KR)

(73) Assignee: KT & G CORPORATION, Daejeon (KR)

( * ) Notice: Subject to any disclaimer, the term of this patent is extended or adjusted under 35 U.S.C. 154(b) by 0 days.

(21) Appl. No.: 18/266,322

(22) PCT Filed: May 23, 2022

(86) PCT No.: PCT/KR2022/007295
§ 371 (c)(1),
(2) Date: Jun. 9, 2023

(87) PCT Pub. No.: WO2022/255700
PCT Pub. Date: Dec. 8, 2022

(65) Prior Publication Data

US 2023/0389613 A1 Dec. 7, 2023

(30) Foreign Application Priority Data

Jun. 1, 2021 (KR) ..... 10-2021-0070966

(51) Int. Cl.
*A24F 13/00* (2006.01)
*A24F 40/20* (2020.01)
(Continued)

(52) U.S. Cl.
CPC ..... *A24F 40/465* (2020.01); *A24F 40/20* (2020.01); *A24F 40/485* (2020.01); *A24F 40/51* (2020.01);
(Continued)

(58) Field of Classification Search
CPC ..... A24F 47/00
(Continued)

(56) References Cited

U.S. PATENT DOCUMENTS 5,878,752 A * 3/1999 Adams ..... A24F 40/465 131/194
9,717,277 B2 8/2017 Mironov
(Continued)

FOREIGN PATENT DOCUMENTS

JP 2020-516262 A 6/2020
JP 2021-509806 A 4/2021
(Continued)

OTHER PUBLICATIONS

Korean Office Action(Non-Final Rejection) for a corresponding patent application No. 10-2022-0083490, dated Jan. 18, 2023.
(Continued)

*Primary Examiner* — Phuong K Dinh
(74) *Attorney, Agent, or Firm* — Sughrue Mion, PLLC

(57) ABSTRACT

Provided is an aerosol generating apparatus including: a susceptor configured to heat an aerosol generating article inserted into an accommodation space of the aerosol generating apparatus; an induction coil arranged around the susceptor and configured to heat the susceptor by induction heating; a switching module configured to switch an electrical path of the induction coil; and a controller electrically connected to the switching module and configured to detect insertion of the aerosol generating article on the basis of a change in an inductance of the induction coil by setting a
(Continued)

control mode for the induction coil to a reception mode, and when the insertion of the aerosol generating article is detected, switch the control mode to a transmission mode for activating the induction heating, via the switching module.

6 Claims, 8 Drawing Sheets

(51) Int. Cl.

| | |
|---|---|
| ***A24F 40/465*** | (2020.01) |
| ***A24F 40/485*** | (2020.01) |
| ***A24F 40/51*** | (2020.01) |
| ***A24F 40/53*** | (2020.01) |
| ***A24F 40/95*** | (2020.01) |
| *A24F 40/57* | (2020.01) |

(52) U.S. Cl.
CPC ..... *A24F 40/53* (2020.01); *A24F 40/95* (2020.01); *A24F 40/57* (2020.01)

(58) Field of Classification Search
USPC ..... 131/328–329
See application file for complete search history.

(56) References Cited

U.S. PATENT DOCUMENTS

| | | | | |
|---|---|---|---|---|
| 2009/0230117 | A1 | 9/2009 | Fernando et al. | |
| 2016/0206000 | A1 | 7/2016 | Lord et al. | |
| 2020/0022412 | A1 | 1/2020 | Abi Aoun et al. | |
| 2020/0390156 | A1* | 12/2020 | An | A24F 40/465 |
| 2021/0007393 | A1 | 1/2021 | Jung et al. | |
| 2021/0015166 | A1 | 1/2021 | Lee | |
| 2021/0076736 | A1 | 3/2021 | Fernando et al. | |
| 2021/0093013 | A1 | 4/2021 | Potter | |
| 2021/0127748 | A1 | 5/2021 | Lim et al. | |
| 2022/0142249 | A1 | 5/2022 | Lim et al. | |

FOREIGN PATENT DOCUMENTS

| | | | |
|---|---|---|---|
| KR | 10-2000-0046282 | A | 7/2000 |
| KR | 10-2011-0096548 | A | 8/2011 |
| KR | 10-1648324 | B1 | 8/2016 |
| KR | 10-2019-0130021 | A | 11/2019 |
| KR | 10-2020-0061233 | A | 6/2020 |
| KR | 10-2020-0073692 | A | 6/2020 |
| KR | 10-2020-0090214 | A | 7/2020 |
| KR | 10-2021-0006088 | A | 1/2021 |
| KR | 10-2231228 | B1 | 3/2021 |
| WO | 2015/177256 | A1 | 11/2015 |
| WO | 2015/177294 | A1 | 11/2015 |
| WO | 2021/037403 | A1 | 3/2021 |

OTHER PUBLICATIONS

Korean Office Action(Notice of Allowance) for a corresponding Korean application No. 10-2022-0083490, dated Feb. 3, 2023.
International Search Report for PCT/KR2022/007295 dated Aug. 22, 2022.
Written Opinion for PCT/KR2022/007295 dated Aug. 22, 2022.
Korean Office Action dated Aug. 1, 2023 in Application No. 10-2021-0070966.
Japanese Office Action issued Nov. 7, 2023 in Application No. 2023-535736.

* cited by examiner

AEROSOL GENERATING APPARATUS FOR DETECTING INSERTION OF AEROSOL GENERATING ARTICLE AND OPERATION METHOD THEREOF

CROSS REFERENCE TO RELATED APPLICATIONS

This application is a National Stage of International Application No. PCT/KR2022/007295 filed May 23, 2022, claiming priority based on Korean Patent Application No. 10-2021-0070966 filed Jun, 1, 2021.

TECHNICAL FIELD

One or more embodiments relate to an aerosol generating apparatus for detecting insertion of an aerosol generating article via an induction coil and an operation method thereof.

BACKGROUND ART

Recently, the demand for alternative methods to overcome the shortcomings of general cigarettes has increased. For example, there is increasing demand for an aerosol generating apparatus that generates an aerosol by heating an aerosol generating material in an aerosol generating article (e.g., cigarette) without combustion.

Also, a method of automatically turning on power of an aerosol generating apparatus when insertion of a cigarette into the aerosol generating apparatus is detected has been actively researched. To this end, the aerosol generating apparatus may include a separate sensor (e.g., a pressure sensor, a film sensor, an optical sensor, or an infrared sensor) to detect the insertion of a cigarette.

DISCLOSURE OF INVENTION

Technical Problem

When the aerosol generating apparatus includes a separate sensor to implement the method of automatically turning on the power of the aerosol generating apparatus, the complexity of hardware and manufacturing cost may increase. In addition, since the aerosol generating apparatus has a relatively small size, it is challenging to modify the design of the aerosol generating apparatus to provide a space for mounting the separate sensor.

One or more embodiments include an aerosol generating apparatus for detecting an insertion of an aerosol generating article in one mode and performing a heating operation in another mode to generate aerosol, by switching a control mode for an induction coil, even without including a separate sensor for detecting an insertion of a cigarette.

The technical problems to be solved by embodiments of the present disclosure are not limited to the aforementioned problems, and unmentioned technical problems may be clearly understood by one of ordinary skill in the art to which the embodiments pertain from the description and accompanying drawings.

Solution to Problem

According to one or more embodiments, an aerosol generating apparatus includes: a susceptor configured to heat an aerosol generating article inserted into an accommodation space of the aerosol generating apparatus; an induction coil arranged around the susceptor and configured to heat the susceptor by induction heating; a switching module configured to switch an electrical path of the induction coil; and a controller electrically connected to the switching module and configured to detect an insertion of the aerosol generating article on the basis of a change in an inductance of the induction coil by setting a control mode for the induction coil to a reception mode, and when the insertion of the aerosol generating article is detected, switch the control mode to a transmission mode for activating the induction heating, via the switching module.

According to one or more embodiments, an operation method of an aerosol generating apparatus, includes: setting a control mode for an induction coil to a reception mode; detecting an insertion of an aerosol generating article on the basis of a change in an inductance of the induction coil; and, when the insertion of the aerosol generating article is detected, switching the control mode to a transmission mode for activating induction heating by the induction coil, via a switching module.

Advantageous Effects of Invention

According to one or more embodiments, even without a separate sensor for detecting an insertion of a cigarette, insertion of a cigarette may be detected using an induction coil and a heating operation may be controlled based on the detection. As a result, a space for a separate sensor is not required in the aerosol generating apparatus.

Also, according to one or more embodiments, the smallest amount of power may be consumed to determine whether or not the aerosol generating article is inserted, and thus the battery power of the aerosol generating apparatus may be saved.

MODE FOR THE INVENTION

With respect to the terms used to describe in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and operation and can be implemented by hardware components or software components and combinations thereof.

As used herein, an aerosol generating apparatus may be an apparatus which generates an aerosol from an aerosol generating material so that the aerosol may be directly inhaled into a user's lungs through the user's mouth. For example, the aerosol generating apparatus may be a holder that can receive an aerosol generating article (e.g., cigarette).

As used herein, the term "puff" may refer to the user's inhalation, and the inhalation may refer to a user's action of drawing smoke (i.e., aerosol) into the oral cavity, nasal cavity, or lungs through the user's mouth or nose.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

Figure 1A:
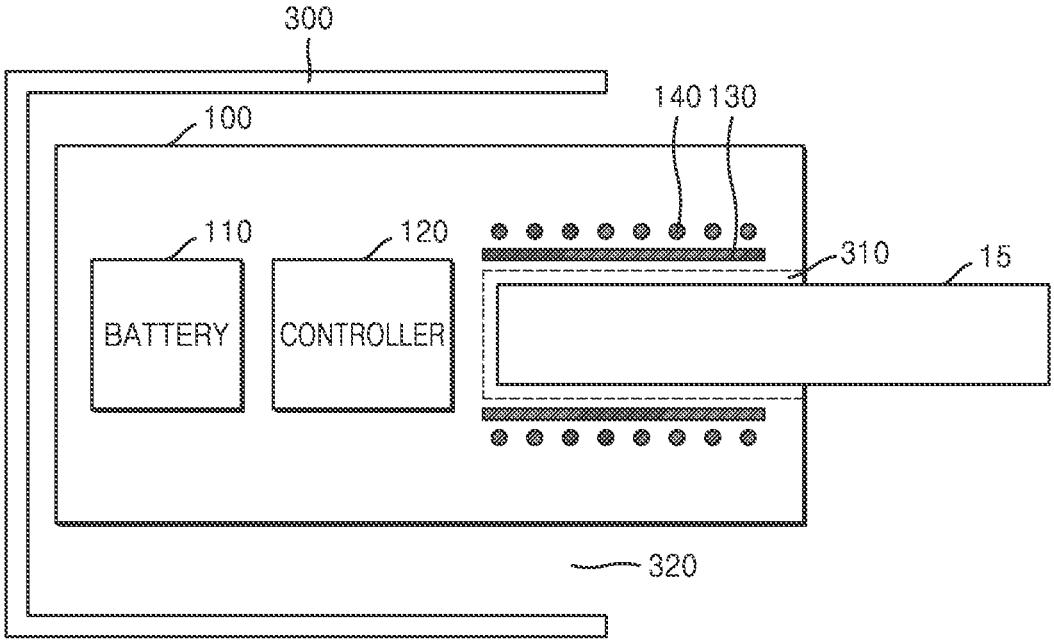
FIG. 1A is a diagram illustrating elements constituting an aerosol generating apparatus according to an embodiment.

FIG. 1A is a diagram illustrating elements constituting an aerosol generating apparatus according to an embodiment.

Referring to FIG. 1A, an aerosol generating apparatus 100 may include a susceptor 130, an induction coil 140, a battery 110, and a controller 120. However, the aerosol generating apparatus 100 is not limited thereto, and may further include other general-purpose components, in addition to the components illustrated in FIG. 1.

The aerosol generating apparatus 100 may generate an aerosol by heating an aerosol generating article 15 accommodated in the aerosol generating apparatus 100 by induction heating. The induction heating may refer to a method of heating the susceptor 130 by applying an alternating magnetic field having a periodically changing direction to the susceptor 130.

When the alternating magnetic field is applied to the susceptor 130, energy loss may occur in the susceptor 130 due to eddy current loss and hysteresis loss, and the lost energy may be emitted from the susceptor 130 as heat energy. As an amplitude or frequency of the alternating magnetic field applied to the susceptor 130 increases, more heat energy may be emitted from the susceptor 130. The heat energy from the susceptor 130 may be transferred to the aerosol generating article 15. In an embodiment, the susceptor 130 may be provided in the aerosol generating apparatus 100 in a shape such as a piece, a flake, or a strip.

At least a portion of the susceptor 130 may be formed of a ferromagnetic substance. For example, the susceptor 130 may include metal or carbon. The susceptor 130 may include at least one of ferrite, a ferromagnetic alloy, stainless steel, and aluminum (Al). Also, the susceptor 130 may include at least one of ceramic such as graphite, molybdenum, silicon carbide, niobium, a nickel alloy, a metal film, or zirconia, transition metal such as nickel (Ni) or cobalt (Co), and metalloid such as boron (B) or phosphorus (P).

The aerosol generating apparatus 100 may accommodate the aerosol generating article 15. The aerosol generating apparatus 100 may include a first accommodation space 310 for accommodating the aerosol generating article 15. The susceptor 130 may be arranged in the first accommodation space 310 for accommodating the aerosol generating article 15.

The susceptor 130 may surround at least a portion of an outer surface of the aerosol generating article 15 accommodated in the aerosol generating apparatus 100. For example, the susceptor 130 may surround a tobacco medium included in the aerosol generating article 15. Accordingly, heat may be more efficiently transferred from the susceptor 130 to the tobacco medium.

The induction coil 140 may be provided in the aerosol generating apparatus 100. The induction coil 140 may apply an alternating magnetic field to the susceptor 130. Specifically, when an alternating current is applied to the induction coil 140, an alternating magnetic field having a periodically changing direction may be formed inside the induction coil 140. When the susceptor 130 is located inside the induction coil 140 and is exposed to the alternating magnetic, the susceptor 130 may generate heat, and the aerosol generating article 15 accommodated in the first accommodation space 310 of the aerosol generating apparatus 100 may be heated.

The induction coil 140 may be wound along an outer surface of the susceptor 130. In addition, the induction coil 140 may be wound along an inner surface of an outer housing of the aerosol generating apparatus 100. The susceptor 130 may be located in an inner space of the induction coil 140. Accordingly, when power is supplied to the induction coil 140, an alternating magnetic field generated by the induction coil 140 may be applied to the susceptor 130.

The induction coil 140 may extend in a longitudinal direction of the aerosol generating apparatus 100. The induction coil 140 may extend to an appropriate length in the longitudinal direction. For example, the induction coil 140 may extend to a length corresponding to a length of the susceptor 130, or may extend to a length that is longer than the length of the susceptor 130.

The induction coil 140 may be arranged at a position appropriate for applying an alternating magnetic field to the susceptor 130. For example, the induction coil 140 may be arranged at a position corresponding to the susceptor 130. The efficiency of applying the alternating magnetic field of the induction coil 140 to the susceptor 130 may be improved by the size and arrangement of the induction coil 140 as described above.

In an embodiment, the aerosol generating apparatus 100 may set a control mode for the induction coil 140. For example, the aerosol generating apparatus 100 may set the control mode to a reception mode to detect, via the induction coil 140, an insertion of a cigarette or may set the control mode to a transmission mode to heat the susceptor 130 via the induction coil 140. In an embodiment, the controller 120 may set the control mode for the induction coil 140 to the reception mode and detect an insertion of the aerosol generating article 15 on the basis of a change in an inductance of the induction coil 140. When the insertion of the aerosol generating article 15 is detected, the controller 120 may switch, via a switching module, the control mode for the induction coil 140 to the transmission mode.

When the amplitude or frequency of the alternating magnetic field formed by the induction coil 140 is changed, the degree to which the susceptor 130 heats the aerosol generating article 15 may also be changed. The amplitude or frequency of the alternating magnetic field formed by the induction coil 140 may be changed by power applied to the induction coil 140. In this respect, the aerosol generating apparatus 100 may control heating of the aerosol generating article 15 by adjusting the power applied to the induction coil 140. For example, the aerosol generating apparatus 100 may control an amplitude and frequency of an alternating current applied to the induction coil 140.

As an example, the induction coil 140 may be implemented as a solenoid. In this case, the a solenoid may be wound along the inner surface of the outer housing of the aerosol generating apparatus 100, and the susceptor 130 and the aerosol generating article 15 may be located in an inner space of the solenoid. A material of a conductor constituting the solenoid may be copper (Cu). However, the material of the conductor constituting the solenoid is not limited thereto, and may include an alloy including any one or at least one of silver (Ag), gold (Au), aluminum (Al), tungsten (W), zinc (Zn), and nickel (Ni).

The battery 110 may supply power to the aerosol generating apparatus 100. In particular, the battery 110 may supply power to the induction coil 140. The battery 110 may supply a direct current to the aerosol generating apparatus 100 and may include a converter for converting the direct current into an alternating current supplied to the induction coil 140.

The battery 110 may supply a direct current to the aerosol generating apparatus 100. The battery 110 may be a lithium iron phosphate (LiFePO4) battery, but is not limited thereto. For example, the battery 110 may be a lithium cobalt oxide (LiCo2) battery, a lithium titanate battery, a lithium polymer (LiPoly) battery, or the like.

The converter may include a low-pass filter that performs filtering on the direct current supplied from the battery and outputs the alternating current supplied to the induction coil 140. The converter may further include an amplifier for amplifying the direct current supplied from the battery. For example, the converter may be implemented by a low-pass filter constituting a load network of a class-D amplifier.

The controller 120 may control power supplied to the induction coil 140. The controller 120 may control the battery 110 to adjust the power supplied to the induction coil 140. For example, the controller 120 may perform control for constantly maintaining a temperature at which the susceptor 130 heats the aerosol generating article 15, on the basis of a temperature of the susceptor 130.

In an embodiment, the controller 120 may control the power supplied to the induction coil 140, according to the control mode for the induction coil 140. For example, the controller 120 may set the power applied to the induction coil 140 to first power when the control mode is the reception mode, and may set the power applied to the induction coil 140 to second power greater than the first power when the control mode is the transmission mode.

Figure 1B:
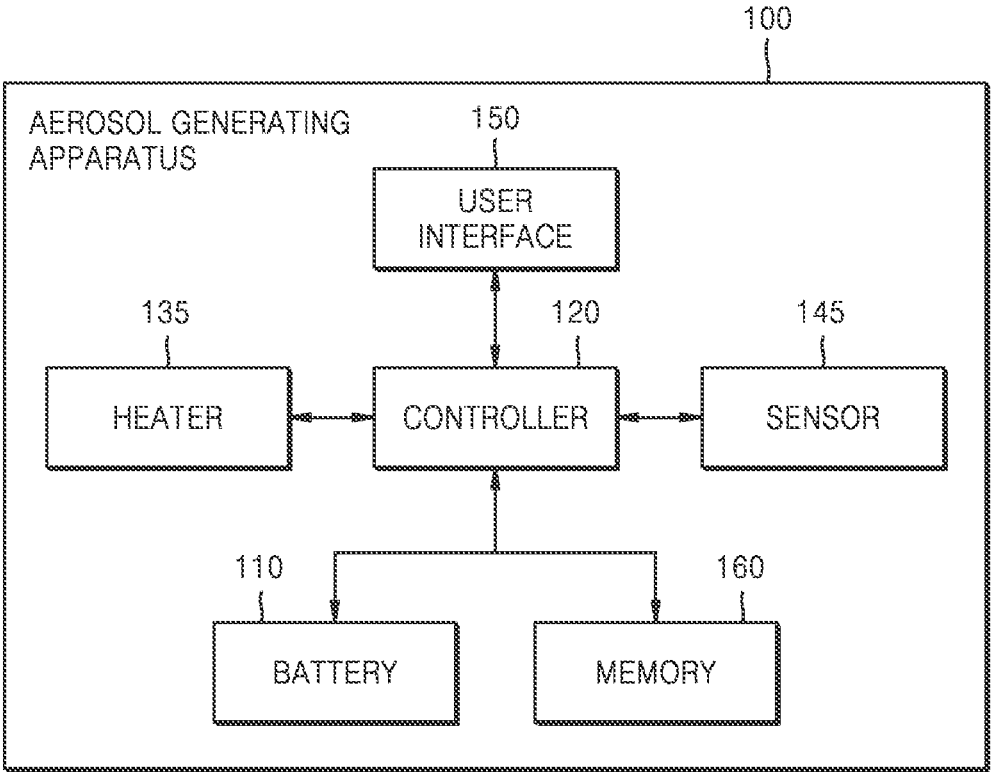
FIG. 1B illustrates a block diagram of an aerosol generating apparatus according to an embodiment.

FIG. 1B illustrates a block diagram of an aerosol generating apparatus according to an embodiment.

Referring to FIG. 1B, the aerosol generating device 100 may include a battery 110, a heater 135, a sensor 145, a user interface 150, a memory 160 and a controller 120. However, the internal structure of the aerosol generating device 100 is not limited to the structures illustrated in FIG. 1B. According to the design of the aerosol generating device 100, it will be understood by one of ordinary skill in the art that some of the components shown in FIG. 1B may be omitted or new components may be added.

The battery 110 supplies power to be used for the aerosol generating device 100 to operate. The battery 110 may supply power such that the heater 135 may be heated. In addition, the battery 110 may supply power required for operation of other components included in the aerosol generating device 100, that is, the sensor 145, the user interface 150, the memory 160, and the controller 120. The battery 110 may be a rechargeable battery or a disposable battery.

In an embodiment, the heater 135 may include a susceptor (e.g., the susceptor 130 of FIG. 1A) and an induction coil (e.g., the induction coil 140 of FIG. 1A). For example, when the heater 135 of the aerosol generating apparatus 100 is an induction heating type, the controller 120 may apply an alternating current to the induction coil 140 to generate an alternating magnetic field. As the alternating magnetic field generated by the induction coil 140 is applied to the susceptor 130, the susceptor 130 may be heated and heat an aerosol generating article (e.g., the aerosol generating article 15 of FIG. 1A).

In an embodiment, the susceptor 130 may be arranged to surround at least a portion of an outer surface of the aerosol generating article 15, or may be arranged inside the aerosol generating article 15. For example, the susceptor 130 may surround a tobacco medium included in the aerosol generating article 15. As another example, the susceptor 130 may be arranged in a medium portion of the aerosol generating article 15 including the tobacco medium. In an embodiment, the controller 120 may set a control mode for the induction coil 140 to a reception mode or a transmission mode regardless of whether the susceptor 130 is arranged to surround at least the portion of the outer surface of the aerosol generating article 15, or is arranged inside the aerosol generating article 15.

The aerosol generating device 100 may include at least one sensor 145. A result sensed by the sensor 145 is transmitted to the controller 120, and the controller 120 may control the aerosol generating device 100 to perform various functions such as controlling the operation of the heater 135, restricting smoking, and displaying a notification.

For example, the at least one sensor 145 may include a puff sensor. The puff sensor may detect a user's puff based on any one of a temperature change, a flow change, a voltage change, and a pressure change.

In addition, the at least one sensor 145 may include a temperature sensor for measuring a temperature of the heater 135 (or the aerosol generating article 15). The aerosol generating apparatus 100 may include a temperature sensor for measuring a temperature of the heater 135. Alternatively, the aerosol generating apparatus 100 may not include a separate temperature sensor, and the heater 135 may operate as a temperature sensor. In an embodiment, the heater 135 may operate as the temperature sensor, and the aerosol generating apparatus 100 may further include a separate temperature sensor.

In addition, the at least one sensor 145 may include a temperature sensor for measuring an ambient temperature of the aerosol generating apparatus 100. The ambient temperature is a temperature outside the aerosol generating apparatus 100. The ambient temperature is a temperature of an atmosphere into which the aerosol generated from the aerosol generating article 15 in the aerosol generating apparatus 100 is emitted. The temperature sensor may be arranged outside a housing to measure the ambient temperature, or may be arranged on a path through which external air is introduced into the aerosol generating apparatus 100. The temperature sensor may transmit a value of the measured ambient temperature to the controller 120, and the controller 120 may determine a heating profile for heating the aerosol generating article 15, on the basis of the ambient temperature.

In addition, the at least one sensor 145 may include a humidity sensor. The humidity sensor may measure ambient humidity of the aerosol generating apparatus 100. The ambient humidity is humidity outside the aerosol generating apparatus 100. The ambient humidity is the humidity of an atmosphere into which the aerosol generated from the aerosol generating article 15 in the aerosol generating apparatus 100 is emitted. The humidity sensor may be arranged outside the housing to measure the ambient humidity, or may be arranged on the path through which the external air is introduced into the aerosol generating apparatus 100. The humidity sensor may transmit a value of the measured ambient humidity to the controller 120, and the controller 120 may determine a heating profile for heating the aerosol generating article 15, on the basis of the ambient humidity.

When an insertion of the aerosol generating article 15 is detected, the controller 120 may control the aerosol generating apparatus 100 such that heating automatically starts even without an additional external input. For example, when the insertion of the aerosol generating article 15 is detected, the controller 120 may control the battery 110 to supply power to the induction coil 140. However, the controller 120 is not necessarily limited thereto, and may control the aerosol generating apparatus 100 such that heating starts only when an additional external input is provided.

The user interface 150 may provide the user with information about the state of the aerosol generating device 100. The user interface 150 may include various interfacing devices, such as a display or a light emitter for outputting visual information, a motor for outputting haptic information, a speaker for outputting sound information, input/output (I/O) interfacing devices (e.g., a button or a touch screen) for receiving information input from the user or outputting information to the user, terminals for performing data communication or receiving charging power, and communication interfacing modules for performing wireless communication (e.g., Wi-Fi, Wi-Fi direct, Bluetooth, near-field communication (NFC), etc.) with external devices.

However, the aerosol generating device 100 may be implemented by selecting only some of the above-described examples of various user interface 150.

The user interface 150 may include the display for outputting the visual information related to the aerosol generating apparatus 100. Here, the visual information related to the aerosol generating apparatus 100 may include any information related to operation of the aerosol generating apparatus 100. For example, the display may output the information about the state of the aerosol generating apparatus 100 (e.g., whether or not the aerosol generating apparatus 100 is operable, and the like), information about the heater 135 (e.g., preheat start, preheat progress, preheat completion, and the like), information related to the battery 110 (e.g., the remaining capacity of the battery 110, whether or not the battery 110 is operable, and the like), information related to reset of the aerosol generating apparatus 100 (e.g., reset timing, reset progress, reset completion, and the like), information related to cleaning of the aerosol generating apparatus 100 (e.g., cleaning timing, cleaning needed, cleaning progress, cleaning completion, and the like), information related to charging of the aerosol generating apparatus 100 (e.g., charging needed, charging progress, charging completion, and the like), information related to puffs (e.g., the number of puffs, a notice of puff end, and the like), safety-related information (e.g., elapse of use time, and the like), or the like.

The communication interface may be communicatively connected to an external device, an external server, and the like. For example, the communication interface may be implemented as a type that supports at least one communication method from among various types of digital interfaces, AP-based Wi-Fi (e.g., WiFi, wireless local area network (LAN), or the like), Bluetooth, Zigbee, wired/wireless LAN, WAN, Ethernet, IEEE 1394, HDMI, USB, MHL, AES/EBU, Optical. Coaxial, and the like. Also, the communication interface may include a transition minimized differential signaling (TMDS) channel for transmitting video and audio signals, a display data channel (DDC) for transmitting and receiving device information and video- or audio-related information (e.g., enhanced extended display identification data (E-EDID)), and a consumer electronic control (CEC) channel for transmitting and receiving a control signal. However, the communication interface is not limited thereto, and may be implemented as various types of interfaces.

The memory 160, as a hardware component configured to store various pieces of data processed in the aerosol generating device 100, may store data processed or to be processed by the controller 120. The memory 160 may include various types of memories; random access memory (RAM), such as dynamic random access memory (DRAM) and static random access memory (SRAM), etc.; read-only memory (ROM); electrically erasable programmable read-only memory (EEPROM), etc.

The memory 160 may store an operation time of the aerosol generating device 100, the maximum number of puffs, the current number of puffs, at least one temperature profile, data on a user's smoking pattern, etc.

The controller 120 may generally control operations of the aerosol generating device 100. The controller 120 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

Meanwhile, as shown in FIG. 1A, the aerosol generating apparatus 100 may constitute an aerosol generating system together with a separate cradle 300. For example, the cradle 300 may be used to charge the battery 110 of the aerosol generating apparatus 100. For example, while being accommodated in a second accommodation space 320 inside the cradle 300, the aerosol generating apparatus 100 may be supplied with power from a battery of the cradle 300 and charge the battery 110 of the aerosol generating apparatus 100.

Figure 2:
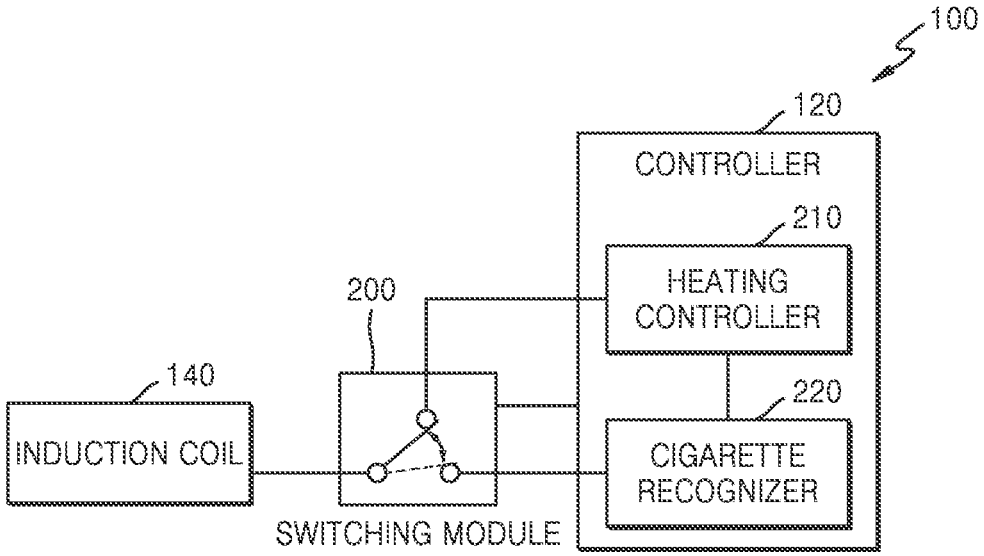
FIG. 2 illustrates a block diagram of an aerosol generating apparatus according to an embodiment.

FIG. 2 illustrates a block diagram of an aerosol generating apparatus according to an embodiment.

Referring to FIG. 2, an aerosol generating apparatus 100 may include an induction coil 140, a switching module 200, and a controller 120.

In an embodiment, the controller 120 may include a heating controller 210 and a cigarette recognizer 220. In an embodiment, the heating controller 210 and the cigarette recognizer 220 may each be implemented as independent hardware. For example, the heating controller 210 may be implemented as a heating integrated circuit (IC) that controls overall heating operation, and the cigarette recognizer 220 may be implemented as a micro controller unit (MCU)

independent of the heating controller 210. In another embodiment, the heating controller 210 and the cigarette recognizer 220 may each be implemented as software. For example, when the controller 120 includes at least one processor, the heating controller 210 may be implemented as a program that controls a heating operation, and the cigarette recognizer 220 may be implemented as a program that controls detection of an insertion of a cigarette and stored in the at least one processor.

In an embodiment, the controller 120 may set a control mode for the induction coil 140. For example, the control mode for the induction coil 140 may include a reception mode Rx and a transmission mode Tx. Here, the reception mode may refer to a mode for detecting an insertion of the aerosol generating article 15 via the induction coil 140, and the transmission mode may refer to a mode for heating the aerosol generating article 15 via the induction coil 140.

In an embodiment, when the control mode for the induction coil 140 is the reception mode, the controller 120 may detect the insertion of the aerosol generating article 15 on the basis of a change in an inductance of the induction coil 140. In an embodiment, when the control mode for the induction coil 140 is the transmission mode, the controller 120 may generate, with respect to the induction coil 140, a variable magnetic field passing through a susceptor (e.g., the susceptor 130 of FIG. 1A). As the variable magnetic field is generated in the induction coil 140, an aerosol generating material of the aerosol generating article 15 may be heated to generate an aerosol.

In an embodiment, the switching module 200 may switch an electrical path of the induction coil 140 according to the control mode set by the controller 120. For example, the switching module 200 may select a terminal that connects the induction coil 140 to one of the elements (e.g., the heating controller 210 and the cigarette recognizer 220) of the controller 120, on the basis of the control mode set by the controller 120.

For example, when the insertion of the aerosol generating article 15 is not detected, the switching module 200 may select a first terminal through which the induction coil 140 and the cigarette recognizer 220 of the controller 120 may be electrically connected to each other. As the first terminal of the switching module 200 is selected, the induction coil 140 may be connected to the cigarette recognizer 220 via a first path. As the induction coil 140 is connected to the cigarette recognizer 220 via the first path, the controller 120 may detect the insertion of the aerosol generating article 15 by acquiring a change in an inductance of the induction coil 140.

When the insertion of the aerosol generating article 15 is detected, the switching module 200 may select a second terminal through which the induction coil 140 and the heating controller 210 of the controller 120 may be electrically connected to each other. As the second terminal of the switching module 200 is selected, the induction coil 140 may be connected to the heating controller 210 via a second path. As the induction coil 140 is connected to the heating controller 210 via the second path, the controller 120 may generate the variable magnetic field in the induction coil 140 to heat the susceptor 130.

In an embodiment, the switching module 200 may be a hardware component for changing an electrical path (e.g., the first path or the second path) between the induction coil 140 and the element of the controller 120 (e.g., the heating controller 210 or the cigarette recognizer 220). For example, the switching module 200 may include a switch circuit using a Metal Oxide Semiconductor Field Effect Transistor (MOSFET). However, the switching module 200 is not limited thereto.

In an embodiment, when the control mode for the induction coil 140 is the reception mode, the controller 120 may detect the insertion of the aerosol generating article 15. For example, when the aerosol generating apparatus 100 is turned on via an external input (e.g., a user input for turning on the aerosol generating apparatus 100), the controller 120 may control the switching module 200 to select a terminal connected to the cigarette recognizer 220. In other words, the induction coil 140 and the cigarette recognizer 220 may be electrically connected to one another via the switching module 200. Accordingly, the controller 120 may detect the insertion of the aerosol generating article 15 on the basis of the change in the inductance of the induction coil 140.

In an embodiment, when the induction coil 140 and the cigarette recognizer 220 are connected to each other via the switching module 200, the cigarette recognizer 220 may control a battery (e.g., the battery 110 of FIG. 1A) to supply first power to the induction coil 140. Here, the first power may refer to a smallest amount of power for detecting a change in an inductance of the inductance coil 140 occurring due to an insertion of a metal material.

In an embodiment, the cigarette recognizer 220 may determine whether or not an aerosol generating article (e.g., the aerosol generating article 15 of FIG. 1A) is inserted into an accommodation space, on the basis of a change in a frequency corresponding to the change in the inductance of the induction coil 140. Here, the change in the frequency corresponding to the change in the inductance may be calculated via Equation 1.

$$f_0 = \frac{1}{2\pi\sqrt{LC}} \quad \text{[Equation 1]}$$

For example, the cigarette recognizer 220 may calculate, via Equation 1, a resonance frequency $f_o$ according to inductance L of the induction coil 140. In other words, when the aerosol generating article 15 is inserted in the induction coil 140, a value of the inductance L of the induction coil 140 may increase, and a value of the resonance frequency $f_o$ measured by the cigarette recognizer 220 may decrease.

In an embodiment, when a change in a resonance frequency (hereinafter "frequency") corresponding to a change in an inductance of the induction coil 140 is greater than a preset value, the cigarette recognizer 220 may determine that the aerosol generating article 15 is inserted. For example, when the aerosol generating article 15 including a metal material is inserted into the induction coil 140, the inductance of the inductance coil 140 may decrease from 3 μH to 2.5 μH. The cigarette recognizer 220 may determine that the aerosol generating article 15 is inserted into the aerosol generating apparatus 100 upon detecting that a frequency change (i.e., change in the resonance frequency) corresponding to the change in the inductance (i.e., 0.5 μH) is greater than or equal to the preset value.

In another embodiment, the cigarette recognizer 220 may also determine whether or not the aerosol generating article 15 is inserted into the accommodation space, on the basis of an amplitude of an oscillation voltage in an oscillation circuit including the induction coil 140. For example, when the aerosol generating article 15 is inserted with respect to the induction coil 140, the amplitude of the oscillation voltage may decrease due to a decrease in a resistance of the oscillation circuit. Here, when the amplitude of the oscillation voltage decreases to a preset amplitude or less, the cigarette recognizer 220 may determine that the aerosol generating article 15 is inserted.

In an embodiment, when the insertion of the aerosol generating article 15 is detected, the controller 120 may switch, via the switching module 200, the control mode for the induction coil 140 from the reception mode to the transmission mode. In other words, the controller 120 may generate, through the induction coil 140, the variable magnetic field passing through the susceptor by switching the control mode for the induction coil 140 to the transmission mode. For example, the controller 120 may control the switching module 200 to select a terminal that may be connected to the heating controller 210 in response to determining that the aerosol generating article 15 is inserted. In other words, the controller 120 may change the electrical path of the induction coil 140 from the first path connected to the cigarette recognizer 220 to the second path connected to the heating controller 210.

In an embodiment, when the induction coil 140 and the heating controller 210 are connected to each other via the switching module 200, the heating controller 210 may control the battery 110 to provide the induction coil 140 with the second power that is greater than the first power. Here, the second power may refer to an amount of power that causes the susceptor 130 to be heated to the extent that an aerosol is generated from the aerosol generating article 15. Alternatively, the second power may also refer to an amount of power for the induction coil 140 to preheat the susceptor 130.

Figure 3:
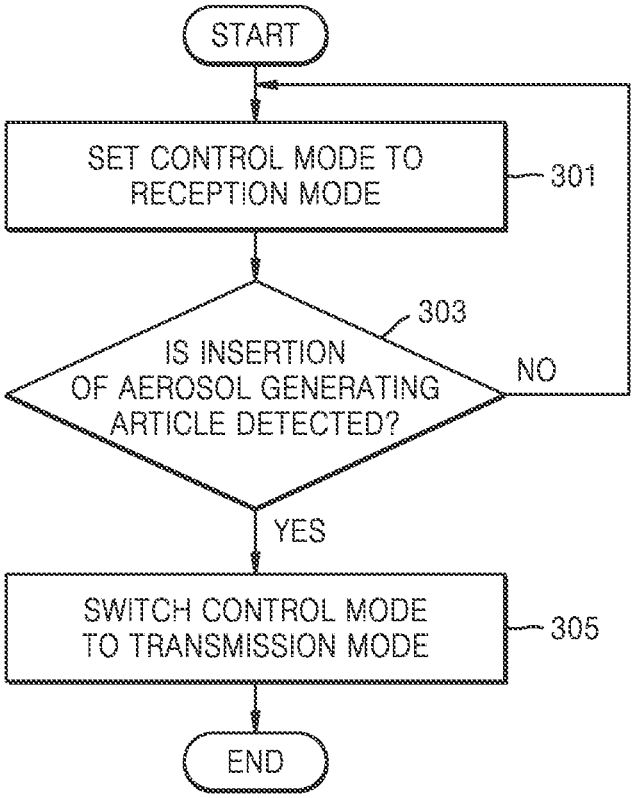
FIG. 3 illustrates a flowchart in which an aerosol generating apparatus controls a control mode for an induction coil, according to an embodiment.

FIG. 3 illustrates a flowchart in which an aerosol generating apparatus controls a control mode for an induction coil, according to an embodiment. The description of FIG. 3 corresponding to, same as, or similar to the above description will be omitted herein.

Referring to FIG. 3, in operation 301, a controller (e.g., the controller 120 of FIG. 2) may set a control mode for an induction coil (e.g., the induction coil 140 of FIG. 2) to a reception mode to detect an insertion of an aerosol generating article (e.g., the aerosol generating article 15 of FIG. 1A). For example, the controller 120 may set the control mode for the induction coil 140 to the reception mode by controlling a switching module (e.g., the switching module 200 of FIG. 2) such that the induction coil 140 and a cigarette recognizer (e.g., the cigarette recognizer 220 of FIG. 2) are connected to each other.

In an embodiment, as the induction coil 140 is connected to the cigarette recognizer 220, the controller 120 may control a battery (e.g., the battery 110 of FIG. 1A) to supply first power to the induction coil 140.

According to an embodiment, in operation 303, the controller 120 may detect whether or not the aerosol generating article 15 is inserted. In an embodiment, the controller 120 may detect the insertion of the aerosol generating article 15, on the basis of a change in an inductance of the induction coil 140 while the first power is supplied to the induction coil 140. For example, while the first power is supplied, a magnetic flux of $\phi_1$ may be generated in the induction coil 140. Here, as shown in Equation 2, a value of inductance L of the induction coil 140 may be proportional to a magnetic flux $\phi$ of the induction coil 140, and may be inversely proportional to a current i flowing through the induction coil 140.

$$L = \frac{n\phi}{i} \quad \text{[Equation 2]}$$

When the aerosol generating article 15 including at least a portion including a metal material approaches the induction coil 140 while the first power is supplied, the value of the inductance L of the induction coil 140 may instantaneously decrease. In detail, as the aerosol generating article 15 approaches the induction coil 140, a magnetic flux in the induction coil 140 decreases. In response, the current i flowing through the induction coil 140 increases to maintain the magnetic flux $\phi_1$ in the induction coil 140. Accordingly, the value of the inductance L of the induction coil 140 decreases. For example, the value of the inductance of the induction coil 140 may decrease from 3 μH to 2.5 μH while the first power is supplied. Upon detecting that the inductance of the induction coil 150 decreased by 0.5 μH, the controller 120 may determine that the aerosol generating article 15 is inserted into an accommodation space of an aerosol generating apparatus.

In an embodiment, the controller 120 may determine whether or not the aerosol generating article 15 is inserted into the accommodation space, on the basis of a frequency change (i.e., the change in the resonance frequency) corresponding to the change in the inductance of the induction coil 140. For example, the controller 120 may detect whether or not the frequency change corresponding to the change in the inductance of the induction coil 140 is greater than or equal to a preset value. When the controller 120 determines that the frequency change corresponding to the change in the inductance of the induction coil 140 is greater than or equal to the preset value, the controller 120 may determine that the aerosol generating article 15 is inserted into the accommodation space of the aerosol generating apparatus. Here, the preset value may refer to a smallest value of the frequency change corresponding to the change in the inductance occurring when the metal material included in the aerosol generating article 15 is inserted into the induction coil 140.

In an embodiment, the aerosol generating article 15 may include a metal material capable of generating the change in the inductance of the induction coil 140. For example, the metal material may be arranged to surround at least a portion of the aerosol generating article 15. Here, the metal material may be aluminum (Al), but is not limited thereto.

According to an embodiment, when the insertion of the aerosol generating article 15 is detected, in operation 305, the controller 120 may switch the control mode for the induction coil 140 to a transmission mode to generate a variable magnetic field with respect to a susceptor (e.g., the susceptor 130 of FIG. 1A). For example, the controller 120 may set the control mode for the induction coil 140 to the transmission mode by controlling the switching module 200 such that the induction coil 140 and a heating controller (e.g., the heating controller 210 of FIG. 2) are connected to each other.

In an embodiment, as the induction coil 140 is connected to the heating controller 210, the controller 120 may control the battery 110 to supply second power to the induction coil 140. For example, the controller 120 may control the battery 110 to supply the second power to the induction coil 140 via the heating controller 210 implemented as a heating IC. Here, the second power may be greater than the first power.

According to an embodiment, when the insertion of the aerosol generating article 15 is not detected, the controller 120 may return to operation 301 and perform the above-described steps again. For example, when the controller 120 determines that the frequency change corresponding to the change in the inductance of the induction coil 140 is less than the preset value, the controller 120 may start detecting the insertion of the aerosol generating article 15 by maintaining the reception mode.

Figure 4A:
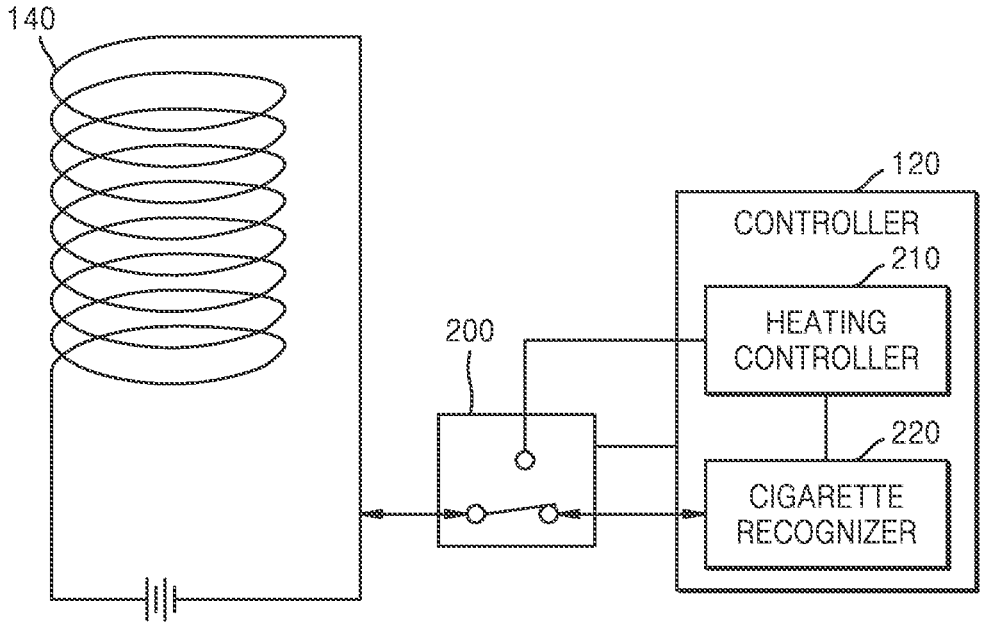
FIG. 4A is a diagram illustrating a first state of a switching module 200 shown in FIG. 2.

FIG. 4A is a diagram illustrating a first state of the switching module 200 shown in FIG. 2.

Referring to FIG. 4A, when a power state of an aerosol generating apparatus is turned on, a controller 120 may control a switching module 200 such that an induction coil 140 and a cigarette recognizer 220 are connected to each other. In an embodiment, the switching module 200 may select a terminal through which the induction coil 140 and the cigarette recognizer 220 may be electrically connected to each other.

In an embodiment, when the induction coil 140 and the cigarette recognizer 220 are connected to each other, the cigarette recognizer 220 may control a battery (e.g., the battery 110 of FIG. 1A) to supply first power to the induction coil 140.

In an embodiment, the cigarette recognizer 220 may acquire data about an amount of change in an inductance of the induction coil 140. For example, as the first power is supplied to the induction coil 140, a magnetic field corresponding to the first power may be generated inside and around the induction coil 140. When a metal material (or a magnetic substance) is inserted in the generated magnetic field, the cigarette recognizer 220 may acquire data about an amount of the inductance change corresponding to the change in the magnetic field due to the metal material. Accordingly, the cigarette recognizer 220 may determine whether or not an aerosol generating article is inserted into an accommodation space of the aerosol generating apparatus (e.g., the aerosol generating apparatus 100 of FIG. 1A), based on the data about the amount of change in the inductance.

Figure 4B:
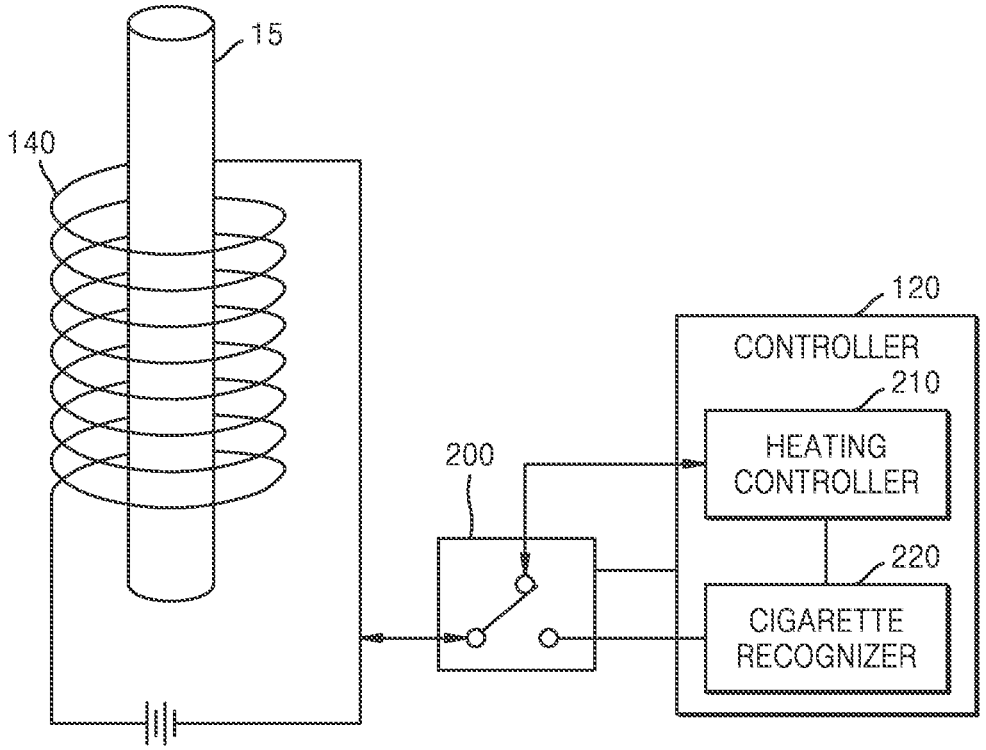
FIG. 4B is a diagram illustrating a second state of the switching module 200 shown in FIG. 2.

FIG. 4B is a diagram illustrating a second state of the switching module 200 shown in FIG. 2.

Referring to FIG. 4B, when a controller 120 determines that an aerosol generating article 15 is inserted, the controller 120 may control a switching module 200 such that an induction coil 140 and a heating controller 210 are connected to each other. In an embodiment, the switching module 200 may select a terminal through which the induction coil 140 and the heating controller 210 may be electrically connected to each other.

In an embodiment, when the induction coil 140 and the heating controller 210 are connected to each other, the heating controller 210 may control the battery 110 to supply second power to the induction coil 140. In an embodiment, the induction coil 140 may generate a variable magnetic field to heat a susceptor (e.g., the susceptor 130 of FIG. 1A) arranged between the induction coil 140 and the aerosol generating article 15. For example, as the second power is supplied to the induction coil 140, a magnetic field corresponding to the second power may be generated inside and around the induction coil 140. Here, the second power may be greater than first power, and an intensity of the magnetic field corresponding to the second power may be greater than an intensity of a magnetic field corresponding to the first power. In an embodiment, when the susceptor 130 is heated via the variable magnetic field generated from the induction coil 140, an aerosol may be generated from the aerosol generating article 15.

Figure 5:
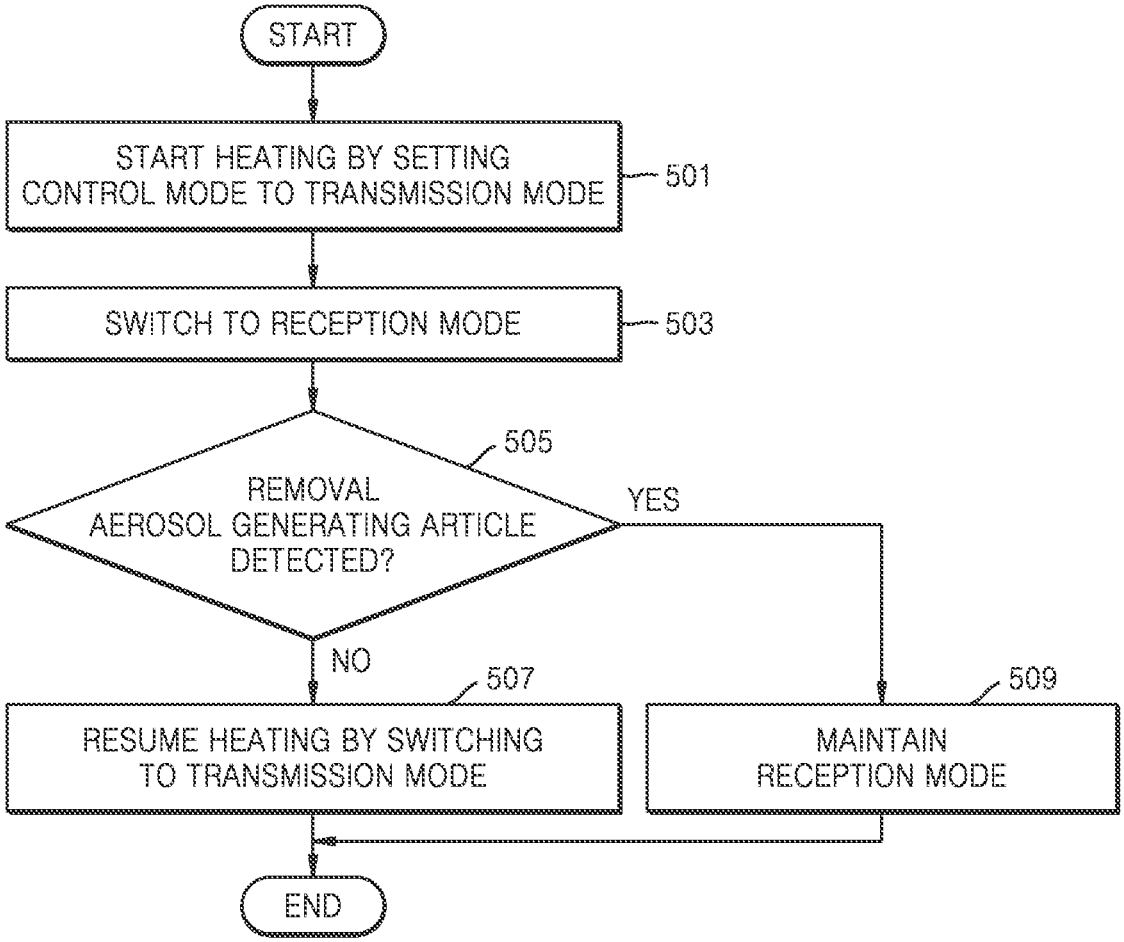
FIG. 5 illustrates a flowchart in which an aerosol generating apparatus controls a control mode for an induction coil, according to an embodiment.

FIG. 5 illustrates a flowchart in which an aerosol generating apparatus controls a control mode for an induction coil, according to an embodiment.

Referring to FIG. 5, in operation 501, a controller (e.g., the controller 120 of FIG. 2) may start a heating operation of an aerosol generating apparatus (e.g., the aerosol generating apparatus 100 of FIG. 2) by setting a control mode for an induction coil (e.g., the induction coil 140 of FIG. 2) to a transmission mode.

In operation 503, the controller 120 may switch the control mode for the induction coil 140 to a reception mode. For example, the controller 120 may periodically switch the control mode for the induction coil 140 to the reception mode, on the basis of a preset period (e.g., three seconds). As another example, the controller 120 may switch the control mode for the induction coil 140 to the reception mode, on the basis of data about at least one of the number of puffs and a smoking time.

In operation 505, the controller 120 may detect whether or not the aerosol generating article 15 is still inserted. In other words, the controller 120 may detect whether or not the aerosol generating article 15 is removed from the accommodation space of the aerosol generating apparatus. As with insertion of the aerosol generating article 15, the inductance of the induction coil 140 and the resonance frequency may also change in the case of removal of the aerosol generating article 5. Therefore, for example, the controller 120 may detect whether or not the aerosol generating article 15 is removed from an accommodation space based on a frequency change corresponding to a change in an inductance of the induction coil 140 to which first power is applied.

When the controller 120 does not detect removal of the aerosol generating article 15 from the accommodation space, in operation 507, the controller 120 may resume the heating operation by switching the control mode for the induction coil 140 to the transmission mode.

On the other hand, when the controller 120 detects removal of the aerosol generating article 15 from the accommodation space, in operation 509, the controller 120 may maintain the reception mode such that the heating operation is not performed.

Figure 6:
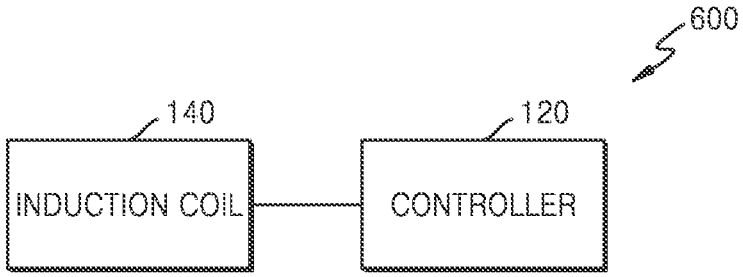
FIG. 6 illustrates a block diagram of an aerosol generating apparatus according to another embodiment.

FIG. 6 illustrates a block diagram of an aerosol generating apparatus according to another embodiment.

Referring to FIG. 6, an aerosol generating apparatus 600 may include an induction coil 140 and a controller 120.

In an embodiment, the controller 120 may set a control mode for the induction coil 140. For example, the aerosol generating apparatus 600 may set the control mode for the induction coil 140 via the controller 120 without a separate switching module. Here, the control mode for the induction coil 140 may include a reception mode Rx and a transmission mode Tx. The reception mode may refer to a mode for detecting an insertion of an aerosol generating article via the induction coil 140, and the transmission mode may refer to a mode for heating the aerosol generating article via the induction coil 140.

In an embodiment, the controller 120 may detect a change in an inductance of the induction coil 140 by setting the control mode for the induction coil 140 to the reception mode. In the reception mode, the controller 120 may detect the insertion of the aerosol generating article on the basis of the change in the inductance of the induction coil 140. In an embodiment, the controller 120 may supply certain power to the induction coil 140 to generate a variable magnetic field, by setting the control mode for the induction coil 140 to the transmission mode. In the transmission mode, the induction coil 140 may heat a susceptor by generating the variable magnetic field, and the aerosol may be generated from the aerosol generating article that is heated by the susceptor.

One embodiment may also be implemented in the form of a recording medium including instructions executable by a computer, such as a program module executable by the computer. The computer-readable recording medium may be any available medium that can be accessed by a computer, including both volatile and nonvolatile media, and both removable and non-removable media. In addition, the computer-readable recording medium may include both a computer storage medium and a communication medium. The computer storage medium includes all of volatile and nonvolatile media, and removable and non-removable media implemented by any method or technology for storage of information such as computer-readable instructions, data structures, program modules, or other data. The communication medium typically includes computer-readable instructions, data structures, other data in modulated data signals such as program modules, or other transmission mechanisms, and includes any information transfer media.

At least one of the components, elements or units (collectively "components" in this paragraph) represented by a block in the drawings, such as the controller 120, the heating controller 210, and the cigarette recognizer 220 illustrated in FIG. 2, may be embodied as various numbers of hardware, software and/or firmware structures that execute respective functions described above, according to an exemplary embodiment. For example, at least one of these components may use a direct circuit structure, such as a memory, processing, logic, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions. Also, at least one of these components may further include a processor such as a central processing unit (CPU) that performs the respective functions, a microprocessor, or the like. Functional aspects of the above exemplary embodiments may be implemented in algorithms that execute on one or more processors. Furthermore, the components represented by a block or processing steps may employ any number of related art techniques for electronics configuration, signal processing and/or control, data processing and the like.

The descriptions of the above-described embodiments are merely examples, and it will be understood by one of ordinary skill in the art that various changes and equivalents thereof may be made. Therefore, the scope of the disclosure should be defined by the appended claims, and all differences within the scope equivalent to those described in the claims will be construed as being included in the scope of protection defined by the claims.

The invention claimed is:

1. An aerosol generating system comprising:

an aerosol generating device including formed therein a first accommodation space including a susceptor and having an aerosol generating article inserted therein; and a cradle including formed therein a second accommodation space having the aerosol generating device accommodated therein, wherein the aerosol generating device includes:

a battery charged by power received from the cradle while the aerosol generating device is accommodated in the second accommodation space;

an induction coil configured to form a magnetic field within the first accommodation space by receiving power from the battery; and a controller electrically connected to the induction coil, wherein the controller is configured to:

measure an amplitude of a voltage applied to the induction coil;

when the measured amplitude of the voltage is less than or equal to a predefined value, determine that the aerosol generating article is inserted into the first accommodation space; and when determining that the aerosol generating article is inserted into the first accommodation space, heat the susceptor by controlling the induction coil to form the magnetic field.

2. The aerosol generating system of claim 1, wherein the controller is configured to: determine whether or not the aerosol generating article is inserted, by using a first amount of power during a first time; and heat the susceptor during a second amount of power during a second time after the first time, wherein the first amount of power is less than the second amount of power.

3. The aerosol generating system of claim 1, wherein the aerosol generating device further includes a puff sensor arranged on a path via which external air is introduced, and electrically connected to the controller, wherein the controller detects an inhalation of a user on the basis of at least one of a change in temperature, a change in flow rate, and a change in pressure, on the path.

4. The aerosol generating system of claim 1, wherein the controller measures the amplitude of the voltage applied to the induction coil, in response to a user input for changing the aerosol generating device from an on state to an off state.

5. The aerosol generating system of claim 1 wherein the susceptor has a strip shape, and the susceptor includes at least one of ferrite, stainless steel, aluminum, graphite, molybdenum, silicon carbide, niobium, nickel, cobalt, boron, and phosphorus.

6. The aerosol generating system of claim 1, wherein the induction coil includes a solenoid wound along the first accommodation space, and the induction coil includes at least one of copper, silver, gold, aluminum, tungsten, zinc, and nickel.

* * * * *